United States Patent [19]

Sargent et al.

[11] Patent Number: 4,751,753

[45] Date of Patent: Jun. 21, 1988

[54] PORTABLE TOILET ENCLOSURE

[75] Inventors: Charles L. Sargent, Ann Arbor; John R. Selina, Farmington Hills; David B. Cameron, Milford, all of Mich.

[73] Assignee: Thetford Corporation, Ann Arbor, Mich.

[21] Appl. No.: 856,330

[22] Filed: Apr. 25, 1986

[51] Int. Cl.[4] ..... E03D 1/00; E03D 7/00

[52] U.S. Cl. ..... 4/321; 4/300.1; 4/476; 4/478

[58] Field of Search ..... 4/300, 300.1, 321, 323, 4/476–478, 661, 480

[56] References Cited

U.S. PATENT DOCUMENTS

| | | | |
|---|---|---|---|
| 341,135 | 5/1886 | Ellison | 4/478 |
| 356,654 | 1/1887 | Martin | 4/321 |
| 409,590 | 8/1889 | Joyce | 4/478 |
| 550,613 | 12/1895 | Harvey | 4/478 |
| 1,229,657 | 6/1917 | Ross | 4/300.1 X |

FOREIGN PATENT DOCUMENTS

| | | | |
|---|---|---|---|
| 667 | of 1915 | United Kingdom | 4/480 |

*Primary Examiner*—Charles E. Phillips
*Attorney, Agent, or Firm*—Harness, Dickey & Pierce

[57] ABSTRACT

A portable toilet enclosure comprises a base and sidewalls attached to sides of the base. The base has a wall in which a portable toilet is disposed. A moveable wall is supported on the sidewalls and is operable to a closed position in which the portable toilet is concealed from view and to an open position which provides use of the portable toilet in the usual manner. The sidewalls incorporate integral hand grips along the top. The bottom edges of the sidewalls provide support for the enclosure on an underlying surface. A pair of wheels are mounted at the lower front corners of the enclosure. With the toilet resting on its sidewalls, the wheels are slightly out of contact with the underlying surface. Forward tipping of the enclosure brings the wheels into contact with the underlying surface while at the same time elevating the lower edges of the sidewalls from the underlying surface so that the enclosure can be rolled. The moveable wall comprises individual tambours hinged together, and is guided on endless tracks on the inner faces of the sidewalls.

3 Claims, 5 Drawing Sheets

PORTABLE TOILET ENCLOSURE

BACKGROUND AND SUMMARY OF THE INVENTION

This invention relates to an enclosure for a self-contained, fresh water flush portable toilet.

Portable toilets have enjoyed considerable popularity, particularly in connection with outdoor recreational activities such as camping. Self-contained, fresh water flush portable toilets have been especially popular and have been commercially sold in what are commonly referred to as one-piece and two-piece types.

In the one-piece type, the bowl, the fresh water storage chamber, and the waste receptacle are inseparable. If it is to be filled with fresh water, the entire toilet is typically carried to a suitable source for filling. Likewise if the waste receptacle is to be dumped, the entire toilet is typically brought to a suitable waste disposal site.

The two-piece types pioneered by the assignee of this invention have come to enjoy superior consumer acceptance because of the ability to separate the seat section, which contains the bowl and fresh water storage chamber, from the holding tank section which forms the waste receptacle. The seat section is separably mounted on the holding tank section, and this enables the two sections to be separated and individually serviced. This promotes user convenience and has come to be held by consumers as preferred over one-piece type portable toilets.

Portable toilets of the one-piece and two-piece types can also be used in connection with other than recreational activities, such as in home or sick room. Indeed the needs of individuals often have to be served by having a portable toilet present in the same room. While these products are designed to offer an attractive appearance, the presence of a portable toilet in the home or sick room is usually recognized as such. Since these rooms will typically be other than bathrooms or lavatories, the presence of a toilet, even one which has an attractive appearance, may be considered by some persons to detract from the surroundings. Such presence may in some cases be considered as a reminder of special needs of an individual who must have a toilet in the same room, and this consideration can be a source of anxiety.

Toilets which are adapted specifically to home and sick room needs may lack the functional features of the two-piece self-contained fresh water flush portable toilets referred to above, and their appearance is probably fairly said to be considerably less attractive than that of such two-piece toilets.

The present invention relates to an enclosure for a portable toilet, particularly a self-contained fresh water flush portable toilet, which promotes the utility of such toilets for home and sick room use. The preferred embodiment of enclosure comprises a horizontal base member and vertical sidewall members forming an interior space for such a toilet. This interior space is opened and closed by a moveable wall. In the closed position, the portable toilet is concealed from view; in the open position the portable toilet is rendered accessible for use.

The preferred form for this moveable wall is a sectionalized sliding one which comprises a number of individual sections whose ends are captured by tracks on the sidewalls to support and guide the moveable wall. The organization and arrangement is such that when the moveable wall is in the closed position, a portion of it forms a generally horizontal top surface which can serve as a seat allowing a person to sit on the enclosure. Thus not only does the enclosure serve to conceal a portable toilet, it also constitutes what may be considered as a form of stool.

The enclosure also possesses features suited to the needs of home users. One of these is the ability to be conveniently moved from place to place. Normally the enclosure rests on the bottom edges of its two sidewalls, but it comprises a pair of wheels via which it can be rolled. However, for the wheels to be placed in contact with the underlying support surface along which it is to be rolled, the enclosure must be tipped at an inclined angle because at rest the two wheels are slightly off the ground. Tipping of the enclosure will bring the wheels into contack with the ground. This same act of tipping of the enclosure also serves to lift the sidewalls off the underlying surface so that only the wheels are in contact with the underlying surface for rolling. When the toilet is at rest with its sidewalls on the underlying surface, it enjoys a very stable support. This is important because many users will use the enclosure as a support aid when either seating or unseating themselves.

Another feature is that the sidewalls of the enclosure comprise hand grip regions near the top which are available as assists for grasping by the individual when sitting onto and rising from either the toilet or the closed enclosure. These same hand grip regions are used for tipping of the enclosure and rolling.

As a further aspect of the stability of the enclosure and toilet combination the enclosure comprises a well in the base member within which the portable toilet seats. The shape of the well closely conforms to the shape of the particular portable toilet with which it is intended to be used so that the portable toilet is essentially prevented from shifting on the base. The configuration of the well in relation to the toilet still allows the toilet to be conveniently removed from and placed into the well when the toilet itself is to be serviced either by adding fresh water and/or dumping its waste contents. The enclosure also supports the portable toilet so that the seat ring is at an elevation which is significantly higher than if the portable toilet were placed directly on the underlying support surface, and this can render the product better suited to the needs of many home users.

The organization and arrangement of the disclosed embodiment of enclosure possesses the ability to be fabricated in an efficient manner with conventional fabrication procedures.

The foregoing features, advantages, and benefits of the invention, along with additional ones, will be seen in the ensuing description and claims which should be considered in conjunction with the accompanying drawings. The drawings disclose a preferred embodiment of the invention according to the best mode contemplated at the present time in carrying out the invention.

DESCRIPTION OF THE PREFERRED EMBODIMENT

Figure 1:
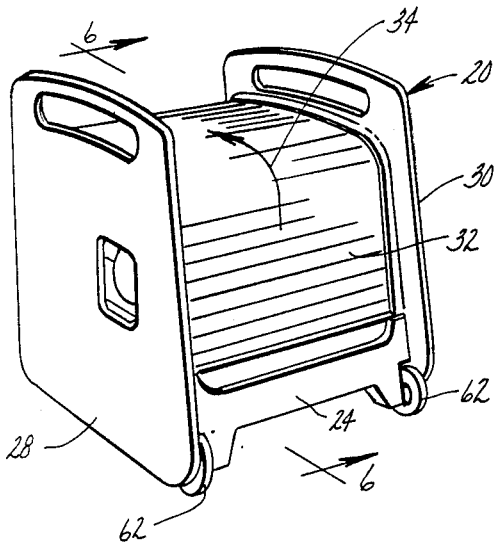
FIG. 1 is a perspective view of a preferred embodiment of portable toilet enclosure embodying principles of the invention and shown in closed position.
Figure 2:
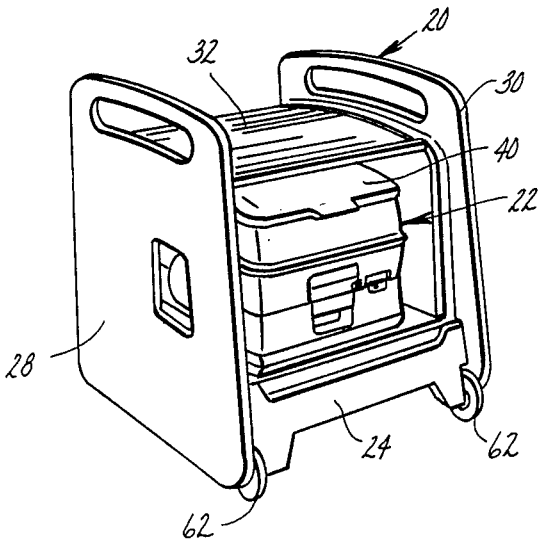
FIG. 2 is a view similar to FIG. 1 but illustrating the enclosure in a partially open position.
Figure 3:
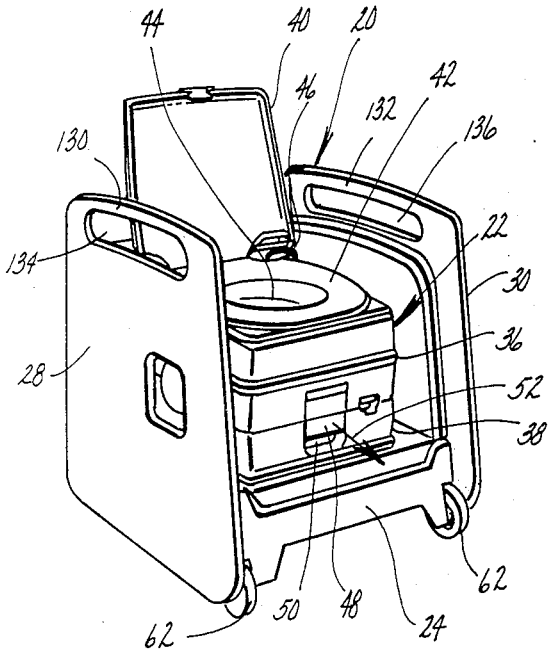
FIG. 3 is a view similar to FIG. 2 illustrating the enclosure fully open and the portable toilet operated to a position for use.

FIGS. 1–4 portray a preferred embodiment of enclosure 20 for a portable toilet 22. The enclosure comprises a base 24 having a well 26 serving to receive and support portable toilet 22. It further comprises a pair of sidewalls 28 and 30 disposed on opposite sides of base 26. A moveable wall 32 is supported by and guided on, sidewalls 28 and 30. FIG. 1 shows the moveable wall 32 in the closed position which conceals portable toilet 22 from view. The enclosure is opened by moving wall 32 in the sense indicated by the arrow 34 in FIG. 1. FIG. 2 illustrates a partially open position and FIG. 3 illustrates a fully open position. In the fully open position the moveable wall 32 is disposed so that portable toilet 22 can be used in the usual manner.

Portable toilet 22 is illustrated as a self-contained two-piece, fresh water flush type comprising an upper seat section 36 and a lower holding tank section 38. The two sections 36 and 38 are separably secured together to jointly form the complete portable toilet. As can be seen from FIGS. 2 and 3 it is only the lower portion of lower holding tank section 38 which occupies well 26. The remainder of the portable toilet is above the well.

In FIG. 3 the toilet is seen ready for use with its lid, or cover, 40 having been swung upwardly and rearwardly to open position. This leaves its seat ring 42 in place on the seat section in overlying relationship to its bowl 44. Bowl has a bottom outlet (not visible) which is in sealed registry with an inlet to holding tank section 38. This relationship cannot be seen in the drawing figures but it is conventional in portable toilets.

Figure 4:
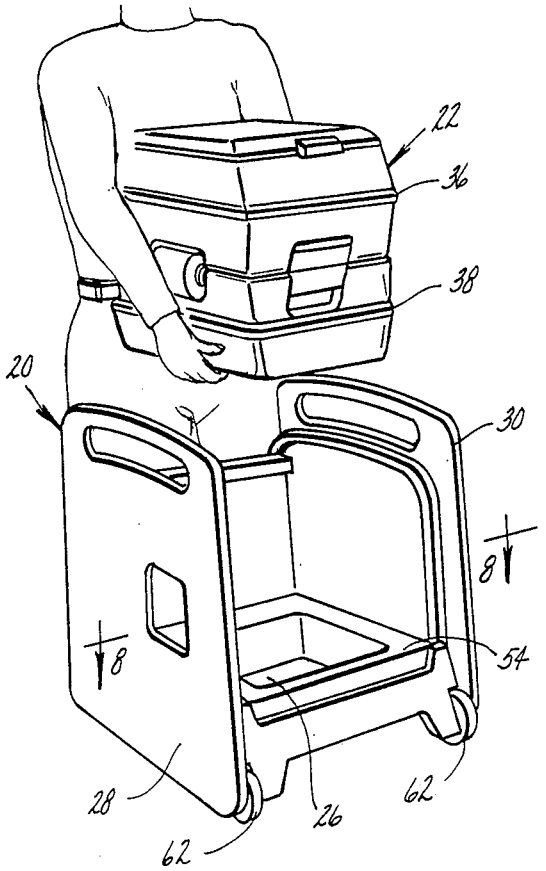
FIG. 4 is a view similar to FIG. 3 illustrating the convenient installation and removal of the portable toilet into and from the enclosure.

A flush valve controls communication between the bowl's bottom outlet and the interior of the holding tank section. This valve is typically mounted on the holding tank section and is operable to close and open the inlet to the holding tank section. The drawing FIGS. 2, 3, and 4 represent the flush valve in closed position. In this position an integral pump 46 on the seat section is operable to draw water from an internal water storage chamber surrounding bowl 44 and introduce it into the bowl. When the toilet is flushed, the flush valve is operated to open position by a valve actuating mechanism on the holding tank section which comprises an operating handle 48. In the closed position of the flush valve as depicted by FIGS. 2, 3, and 4, operating handle 48 is disposed generally within a recess 50 in the front of the toilet. To operate the valve to open position, handle 48 is pulled outwardly in the sense indicated by arrow 52 in FIG. 3. When the handle is so operated, the flush valve opens allowing the contents of the bowl to fall into the holding tank. After the flush, the valve is closed by pushing the handle back into the recess. The disposition of portable toilet 22 within open enclosure 20 is such that handle 48 can be conveniently operated in the usual way because it remains well above the level of well 26.

The use of well 26 to support and locate portable toilet 22 on base 24 is advantageous because the portable toilet can simply be lifted out of and set into the well without any separate devices or procedures being required. Thus when it is necessary to remove the portable toilet from the enclosure for service, such removal and replacement can be easily accomplished. This is illustrated by FIG. 4.

With the general organization and arrangement of enclosure 20 and portable toilet 22 having been explained, further details can now be described with reference to the other drawing figures as well.

Base 24 is preferably fabricated of structural plastic foam. This type of construction provides strength and rigidity to the base without the need for any separate bracing members. Base 24 comprises a top in the form of a generally rectangular horizontal flange 54 projecting outwardly from the top of well 26 around all four sides. Integral stiffening flanges 56 are incorporated at certain locations between the underside of flange 54 and the outside surface of well 26. Along the front, base 24 has what may be considered as an integral skirt 58 which includes notches 60 at the lower corners. An axle shaft 62 is inserted into a suitable aperture in the side of each notch 60 so that each axle shaft projects from the skirt in a direction laterally outwardly. A wheel 64 fits onto each axle shaft and the wheels are captured on the axle shafts by the mounting of the sidewalls 28 and 30 on base 24. The organization and arrangement of the notches 60, axle shafts 62, and wheels 64 in relation to the sidewalls provides for the free rotation of the wheels on the axle shafts.

Figure 5:
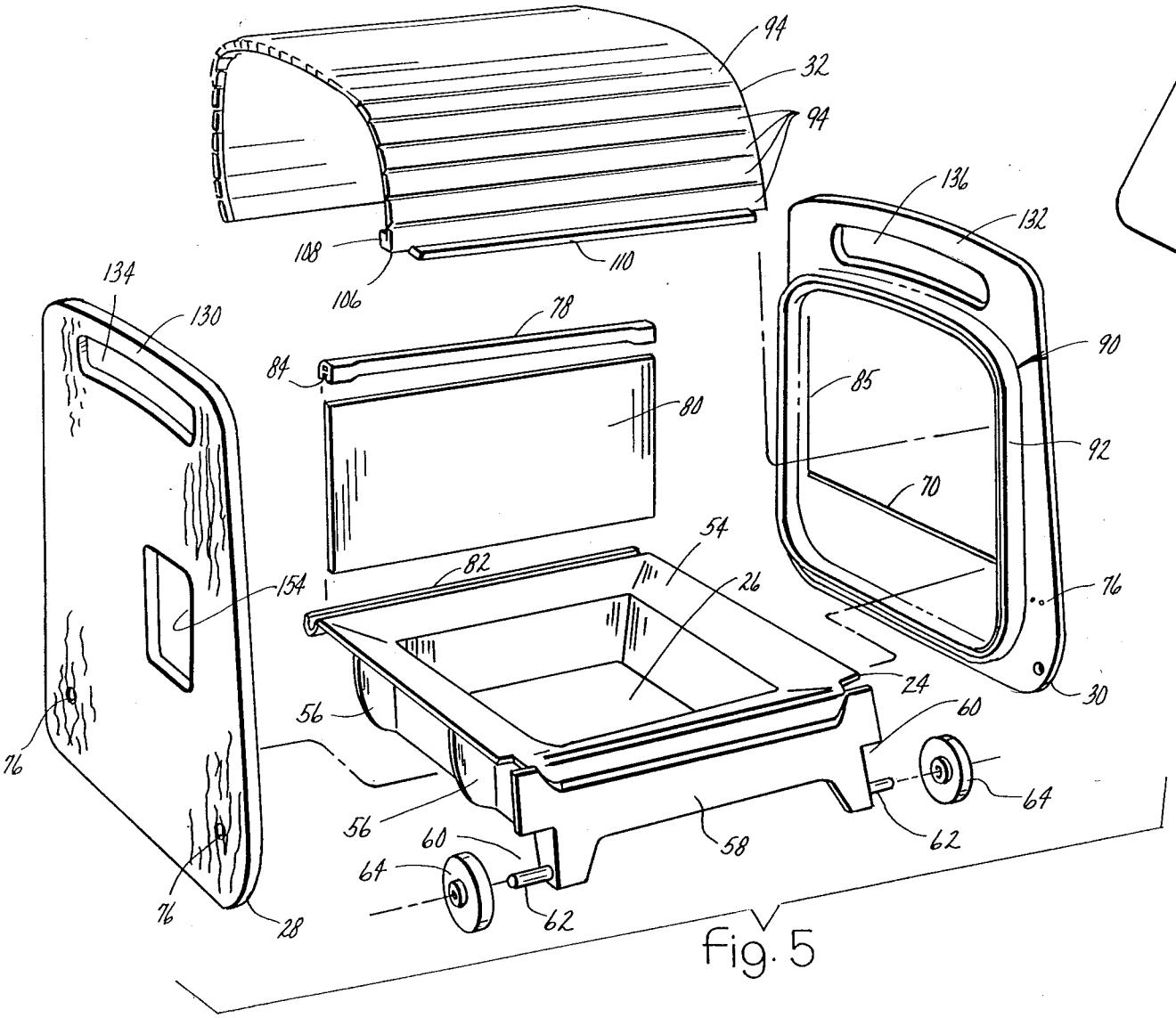
FIG. 5 is an exploded perspective view of the enclosure of FIG. 1 with the portable toilet being omitted for purposes of clarity.

The sidewalls 28 and 30 are advantageously fabricated from conventional press board which is covered by a synthetic laminate. For example, the laminate presents attractive finish which may be a synthetic wood grained appearance for example as can be seen in FIG. 5 in the case of the outside surface of the sidewalls 28, 30.

Horizontal slots 70 are cut into the inside surfaces of the sidewalls and are located and dimensioned for reception of the marginal free edges of the respective sides of the flange 54. Attachment of the sidewalls to the base is completed at four points of fastening, two per sidewall, at the lower corners. The illustrated form of fastening comprise a nut 72 and bolt 74 at each point. The nut is inserted into a corresponding shaped opening behind a wall portion of base 24 which confronts a corresponding overlying lower corner of each sidewall. The wall portions of the base contain holes extending from the nut-receiving openings and aligning with holes 76 in the sidewalls. The bolts are passed through the sidewall holes and the holes in the wall portions of the base and threaded into the captured nuts. Upon tightening of the bolts, the joints are secured and the two sidewalls become attached to the base.

As a further joining aid, a horizontal bar 78 is used to join the two sidewalls at the rear of the enclosure and at an elevation vertically above the elevation at which the sidewalls are attached to the base. In order to complete the concealment of the portable toilet when moveable wall 32 is in closed position, a rear vertical panel 80 is disposed at the rear of the enclosure. The panel is generally rectangular in shape and extends laterally between sidewalls 28, 30 and upwardly from the flange 54 of base 24 to bar 78. The panel is captured vertically between an upwardly open slot 82 extending laterally along the rear edge of flange 54 and a downwardly open slot 84 in bar 78. Lateral capture of the panel is by means of vertical slots 85 in the two sidewalls. The attachment of bar 78 to the two sidewalls is accomplished in an analogous manner to the fastening of the two sidewalls to base 24. Bolts 86 pass through holes in the sidewalls and through holes in endwall portions of the bar. Captured nuts 88 are disposed behind these endwall portions of the bar to receive the shanks of bolts 86. Upon tightening of the bolts into the nuts, the sidewalls are securely joined to the bar.

Moveable wall 32 is supported by and guided on sidewalls 28 and 30 by a track structure, 90 generally. The track structure comprises two endless tracks 92 which are disposed on the laterally inner faces of the two sidewalls directly across from each other. The transverse cross sectional shape of each track is in the form of a channel which is open toward the opposite track. Each track is fastened to its sidewall by any suitable fasteners 93 which do not interfere with the guidance of the moveable wall.

Figure 10:
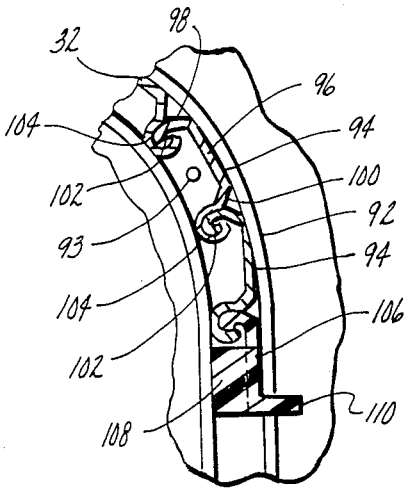
FIG. 10 is an enlarged fragmentary view taken in circle 10 of FIG. 6 to illustrate greater detail.

Moveable wall 32 comprises a series of individual elongate sections, sometimes referred to as tambours, 94 which are hinged in succession along a succession of horizontal axes which lie in a lateral sense across the enclosure. In other words, one of the elongate sides of each individual section 94 is hinged to the juxtaposed elongate side of the immediately succeeding section 94. The individual sections 94, save for the leading one to be hereinafter described in more detail later on, are identical. FIG. 10 portrays more detail of the manner in which the individual sections 94 hinge together.

Each section 94 may be considered to have a generally channel-shaped transverse cross section which comprises a flat central body portion 96 of elongate rectangular shape with complementary hinge portions 98, 100 extending along opposite lengthwise sides of central body portion 96. Hinge portion 98 comprises at its distal end, as viewed in transverse cross section a generally semi-circular curled lip 102 which curls toward the interior of the channel-shaped cross section. Hinge portion 100 also comprises a curled lip 104. This latter curled lip curls however toward the exterior of the channel-shaped cross section and is slightly larger than the curled lip 102. The radius of curvature of the concave interior surface of lip 102 is just slightly smaller than the convex curvature of the exterior surface of lip 104. Lip 104 has a throat dimension which enables it and the immediately adjacent section which is hinged to it to articulate about their co-axis, thus forming the hinge connection between successive sections.

Two sections are joined together by sliding the lip 102 of one into the lip 104 of the other. The moveable wall is fabricated in this manner using an appropriate number of sections 94.

The overall thickness of moveable wall 32 is slightly less than the width of the track channel. This allows the lateral sides of the wall to be received closely within the tracks for support and guidance. The moveable wall may be considered to have a leading edge which rests on base 24 when the moveable wall is closed. This leading edge is on a leading member 106 (FIG. 10) which is hinged to the adjacent section 94. Member 106 has a transverse cross sectional shape which is seen to comprise a lip 102 and a central body 96. It has endwalls 108 which fit closely within the tracks. Hence it forms a guide for sliding motion of the moveable wall along the track which assists in centering the sections with respect to the track. Instead of lip 104, member 106 has a flange 110 which projects outwardly. The flange is used to slide the wall, for example, enabling the wall to be lifted from its closed position simply by an individual placing his or her fingers under the flange and lifting upwardly.

Figure 6:
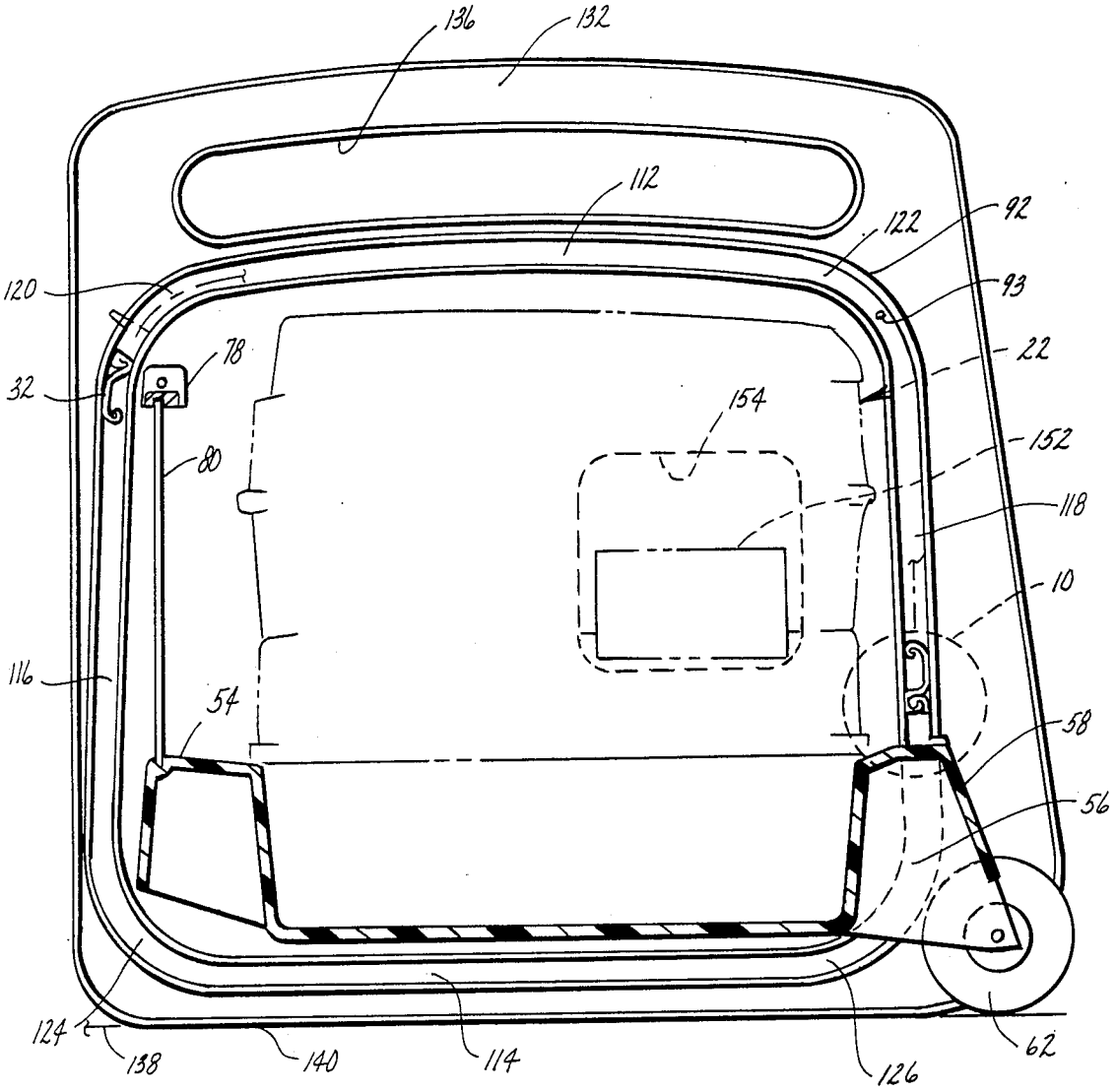
FIG. 6 is an enlarged vertical sectional view through the enclosure of FIG. 1 taken generally in the direction of arrow 6—6.

FIG. 6 portrays the position assumed by moveable wall 32 in the closed position. In this position member 106 is seen resting on flange 54 at the front of base 24. The moveable wall encloses the portable toilet both from the top and the front. At the rear, the trailing section 94 just overlies bar 78 and the very top of panel 80. Hence in the closed position, panel 80 serves substantially as the sole rearward enclosure of the toilet.

Each of the two tracks comprises a generally rectangular endless run and may be considered as having a generally horizontal top segment 112, a generally horizontal bottom segment 114, a generally vertical front segment 116, and a generally vertical rear segment 118. These four segments are joined by curved bend segments 120, 122, 124, 126, as shown. From consideration of FIG. 6 it can be seen that the front and rear segments 116, 118 are not exactly parallel; rather they diverge from each other in the direction from top to bottom. Consequently, the bottom track segment 114 may be considered slightly longer than the top track segment 112. Also the top track segment is not precisely straight rather it has a crown whereby it may be said to lie upon an imaginary arc which has a downwardly concave curvature. The organization and arrangement of the track is such that when the moveable wall is in the full open position, the moveable wall occupies essentially the bottom and rear segments of the track with member 106 disposed approximately at the height of bar 80. The trailing section 94 abuts the stiffening flanges 56, of base 24 which appear in FIG. 6.

Figure 9:
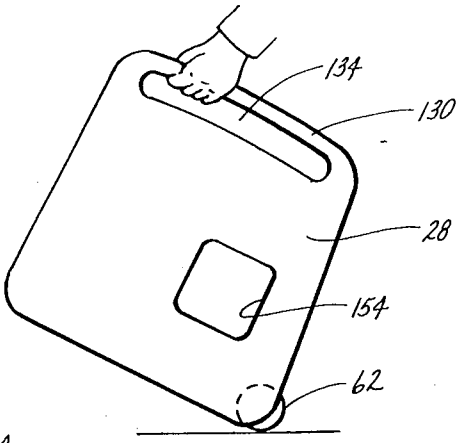
FIG. 9 is a side elevational view on a reduced scale illustrating how the enclosure can be moved from one place to another.

The enclosure is further provided with hand grips 130, 132 at the top of the sidewalls by cutting slots 134, 136 into the sidewalls at a level above the top track segment. These slots are made generally parallel to the tracks so that they have a downwardly facing concave curvature. These hand grips are useful both when moving the enclosure around and when the portable toilet is used by an individual. In FIG. 6 the enclosure is shown supported on an underlying support surface, or floor, 138 by the lower edges 140 of the sidewalls. This provides a very stable and secure support. In FIG. 6 it can be seen that the wheels are spaced slightly off the underlying support surface. When the enclosure is tipped in the manner depicted in FIG. 9, wheels 64 are brought into engagement with surface 138 while the lower edges 140 of the sidewalls are concurrently lifted off surface 138 so that the enclosure is supported solely by the wheels. The enclosure and its portable toilet can then be rolled to any suitable location. This is an especially convenient feature because a very stable support is provided when the toilet is at rest yet the enclosure does not have to be bodily picked up for movement. Not only is this arrangement advantageous for moving along flat surfaces, but it provides a convenience for movement up and down stairs in the manner of a dolly.

In the open position of the enclosure, the portable toilet can be used in the usual manner. As can be seen in FIG. 3, lid 40 can be swung to open position and the pump and the flush valve operated in the usual way. The portable toilet is also disposed at an elevation noticeably above that which would otherwise occupy if it were placed directly on the underlying surface 138 without the benefit of the enclosure. As such, this provides a more convenient elevation of the seat for many individuals.

In the closed position, the illustrated construction has sufficient strength that the top horizontal surface of the moveable wall can form a seating surface for an individual; hence the closed enclosure can function as a form of stall if someone sits on it, but that is not the principal purpose served by the enclosure.

Figure 7:
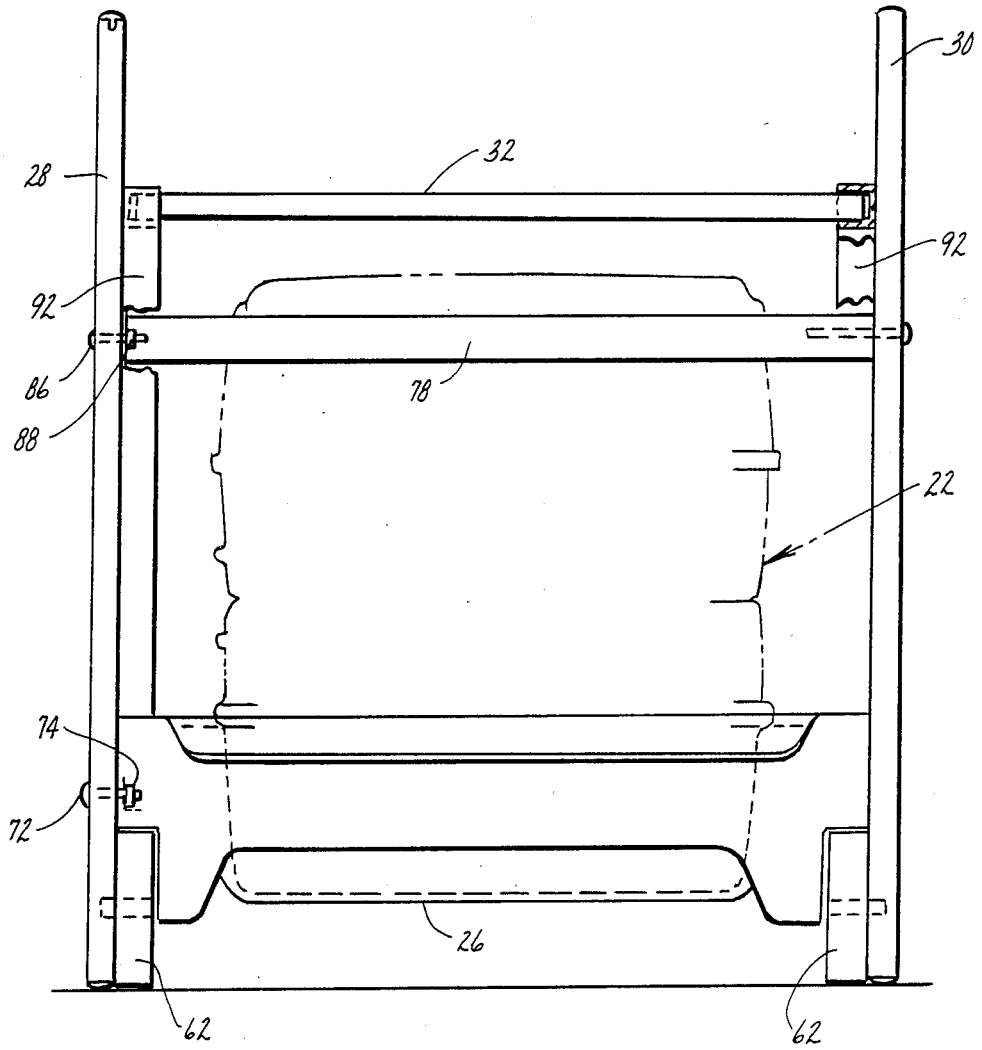
FIG. 7 is a front elevational view of FIG. 1 on an enlarged scale, with portion broken away.
Figure 8:
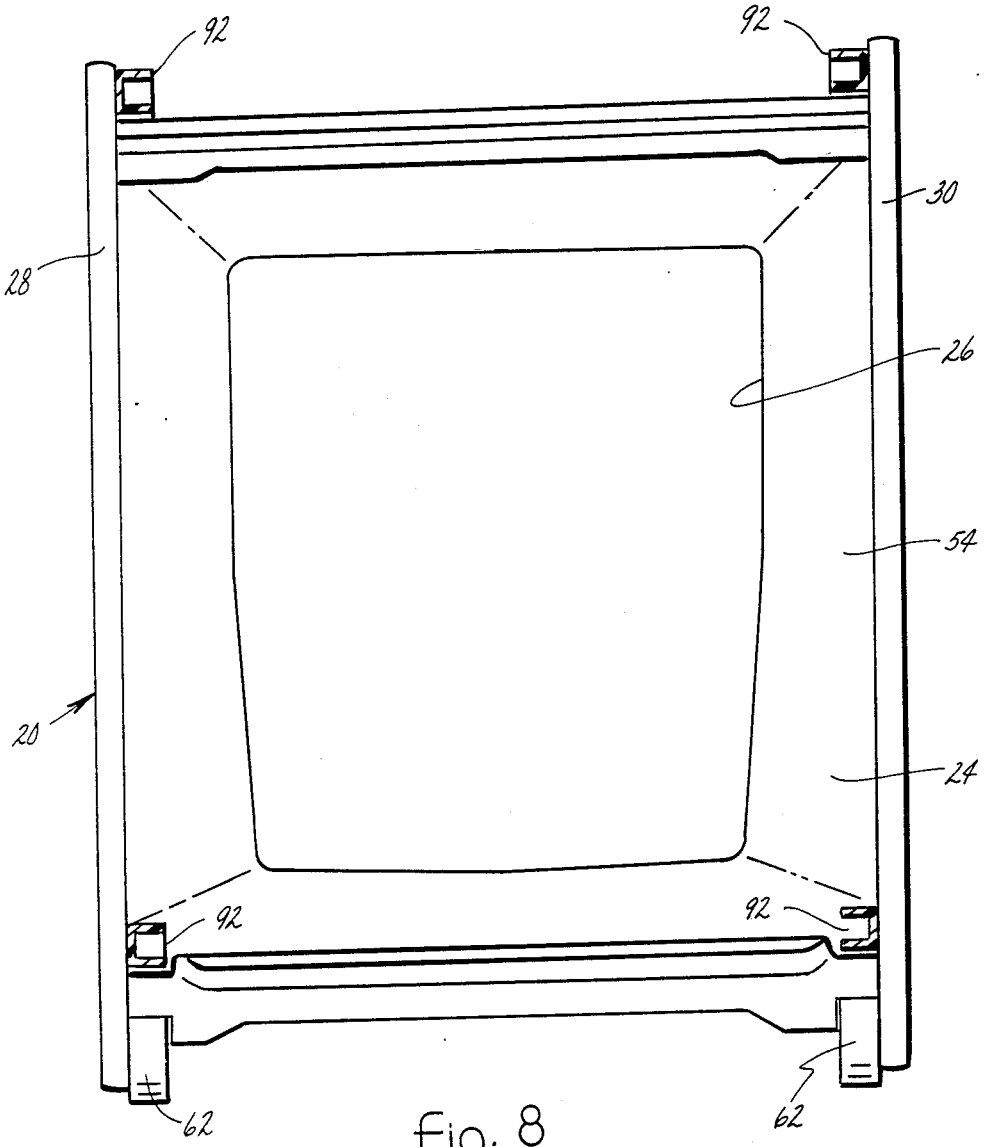
FIG. 8 is a horizontal plan sectional view taken generally in the direction of arrows 8—8 in FIG. 4 on an enlarged scale.
Figure 11:
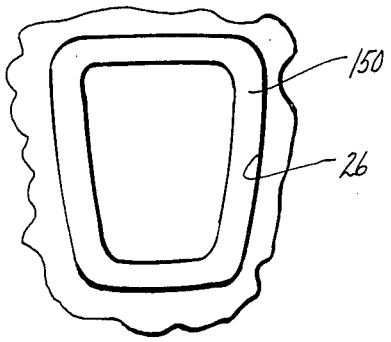
FIG. 11 is a view similar to FIG. 8 but on a reduced scale illustrating a modification.

The enclosure provides a space within which several sizes of conventional portable toilets can be used. In general these portable toilets differ solely in the height of the holding tank section. The well is designed so that the flush valve can be operated in the usual way for the different sizes and the overall height is also sized to accommodate the different heights of toilets. While the plan outline of well 26 is preferably conformed to the same outline as the bottom of the holding tank. (i.e. the foot print of the holding tank) so that the holding tank fits closely within the well (see FIGS. 6, 7, and 8), it is to be appreciated that any given enclosure may still be useful with a portable toilet having a holding tank of smaller size. FIG. 11 portrays an exanple where a smaller holding tank is still received within a well with the use of an adapter ring 150 which serves to provide a proper fit between the two. By changing the well plan outline, a base can be fabricated for closely receiving the bottom of a toilet having a holding tank footprint different from the one of the example.

The disclosed embodiment of enclosure comprises an efficient organization of parts which can be fabricated by conventional fabrication procedures and conveniently assembled to form the finished enclosure. The fabrication of the one-piece base from structural plastic foam provides significant strength. The remainder of the major structured support conprises essentially the two sidewalls and the horizontal bar at the rear. In assembly these parts result in a space which enables the portable toilet to be used in the usual way while providing strength to support the weight of users.

An economical way to manufacture sidewalls 28 and 30 is from conventional pressboard cut to the illustrated shape. The material can be laminated with plastic for a decorative effect and for encasing the pressboard material. The two sidewalls are identical and so are the two tracks 92 which are mounted on the sidewalls. Thus, the enclosure possesses a significant usage of common parts. The individual tambours 94 can be fabricated by conventional fabrication techniques, for example using a suitable plastic such as polyvinyl chloride which can be formed to the illustrated shape. The channel-shaped construction of the individual tambours and their hinged connections, provides for easy operation of the moveable wall between the closed position where it encloses the portable toilet and the open position where it enables the toilet to be used in the usual manner.

Certain portable toilets may comprise a toilet tissue roll holder at the side. This is shown at 152 in FIG. 6 and can also be seen in other views. For these portable toilets, one of the sidewalls may be provided with an access opening 154 whereby a user can reach through the access opening from the exterior and obtain access to a roll of toilet tissue. Thus the enclosure provides a product which can be used to advantage in home or sick room enabling a portable toilet to be available for use as needed in such a location without the portable toilet having to be exposed to view when not in use.

While the preferred embodiment of the invention has been disclosed, it would be appreciated that principles are applicable to other embodiments.

What is claimed is:

1. For a portable toilet of a self-contained fresh water flush type comprising a bowl having an overlying seat for a user, a fresh water storage chamber for a supply of fresh water for use in flushing of the toilet, a waste water chamber where flushed contents from the bowl are collected and user operable control means for introducing water from the fresh water storage chamber into the bowl and flushing waste from the bowl into the waste chamber, an enclosure comprising a generally horizontal base, a well in said base for receiving and supporting such a portable toilet, a pair of vertical sidewalls at the sides of said base, said sidewalls and base cooperatively defining a space for such a portable toilet seated in the well, and well means cooperatively associated with said base and said sidewalls for enclosing such a portable toilet seated in the well, said wall means including a moveable wall which, when in an enclosing position enclosing such a toilet, comprises a generally horizontal portion disposed in vertically overlying relationship to the top of such a portable toilet and a generally vertical portion which is disposed in frontally overlying relationship to the front of such a portable toilet, said moveable wall being operable to a non-enclosing position in which said moveable wall portions are removed from such overlying relationships enabling the user to sit on the toilet and operate said control means, said sidewalls including wheels which, when the enclosure is supported on an underlying surface by said sidewalls, said wheels are out of contact with such an underlying support surface, but upon tipping of the enclosure, said wheels are brought into contact with such underlying support surface while the sidewalls are concurrently elevated from the support surface so that the enclosure can be rolled along such support, via said wheels.

2. An enclosure as set forth in claim 1 wherein said sidewalls include hand grips extending along said sidewalls at a level vertically above said moveable wall.

3. An enclosure as set forth in claim 1 wherein said wheels are disposed on a common axis at the front of said enclosure.

* * * * *